US008820550B2

(12) United States Patent
Detrois et al.

(10) Patent No.: US 8,820,550 B2
(45) Date of Patent: Sep. 2, 2014

(54) ONE-PIECE PACKAGING COMPRISING A CONTAINER AND A CLOSURE

(75) Inventors: Christian Detrois, Golbey (FR); Jean-Paul Cerveny, Vittel (FR)

(73) Assignee: Nestec S.A., Vevey (CH)

( * ) Notice: Subject to any disclaimer, the term of this patent is extended or adjusted under 35 U.S.C. 154(b) by 10 days.

(21) Appl. No.: 13/391,346

(22) PCT Filed: Aug. 19, 2010

(86) PCT No.: PCT/EP2010/062133

§ 371 (c)(1), (2), (4) Date: Feb. 20, 2012

(87) PCT Pub. No.: WO2011/026736

PCT Pub. Date: Mar. 10, 2011

(65) Prior Publication Data

US 2012/0145704 A1 Jun. 14, 2012

(30) Foreign Application Priority Data

Sep. 2, 2009 (EP) ..... 09169198

(51) Int. Cl.

| | |
|---|---|
| ***B65D 39/00*** | (2006.01) |
| ***B65D 8/00*** | (2006.01) |
| ***B65D 47/08*** | (2006.01) |
| ***B65D 43/16*** | (2006.01) |
| ***B65D 55/16*** | (2006.01) |

(52) U.S. Cl.

CPC ..... *B65D 11/04* (2013.01); *B65D 47/08* (2013.01); *B65D 43/16* (2013.01); *B65D 55/16* (2013.01)

USPC ..... 215/237; 215/235

(58) Field of Classification Search

USPC ..... 220/4.01, 254.3, 837; 206/524.6; 215/235, 237

See application file for complete search history.

(56) References Cited

U.S. PATENT DOCUMENTS

| | | | | |
|---|---|---|---|---|
| 3,338,446 | A * | 8/1967 | Faulstich | 215/254 |
| 5,152,411 | A * | 10/1992 | Pope et al. | 215/381 |
| 5,465,856 | A | 11/1995 | Sheffler | |
| 5,690,764 | A * | 11/1997 | Dirksing et al. | 156/69 |
| 6,269,986 | B1 | 8/2001 | Gross | |
| 6,405,896 | B2 * | 6/2002 | Jud et al. | 222/107 |
| 6,511,568 | B1 * | 1/2003 | Eckstein et al. | 156/216 |
| 2001/0050291 | A1 * | 12/2001 | Jud et al. | 222/107 |
| 2006/0201904 | A1 * | 9/2006 | Comeau et al. | 215/237 |
| 2007/0017914 | A1 * | 1/2007 | Shigesada et al. | 220/4.04 |
| 2007/0062906 | A1 * | 3/2007 | Morano et al. | 215/311 |
| 2009/0321379 | A1 * | 12/2009 | Lilienthal et al. | 215/235 |

FOREIGN PATENT DOCUMENTS

FR 2908392 5/2008

OTHER PUBLICATIONS

PCT International Search Report for Application No. PCT/EP2010/062133 with a Mailing Date of Nov. 17, 2010. 3 Pages.

* cited by examiner

*Primary Examiner* — Fenn Mathew
*Assistant Examiner* — Christopher McKinley
(74) *Attorney, Agent, or Firm* — K&L Gates LLP

(57) ABSTRACT

The present invention concerns a packaging comprising a container with a container body (1), and a container opening (2) having an upper edge (3), and a closure element (4) for closing said container, characterized in that the closure element (4) is rigid and is ultrasonically sealed onto the upper edge (3) of the container opening (2), so that said closure element (4) and said container (1, 2) form one single unitary part.

10 Claims, 2 Drawing Sheets

ONE-PIECE PACKAGING COMPRISING A CONTAINER AND A CLOSURE

CROSS REFERENCE TO RELATED APPLICATIONS

The present application is a National Stage of International Application No. PCT/EP2010/062133, filed on Aug. 19, 2010, which claims priority to European Patent Application No. 9169198.0, filed on Sep. 2, 2009, the entire contents of which are being incorporated herein by reference.

FIELD OF THE INVENTION

The present invention concerns a packaging comprising a container and a closure element for closing the container, which are simple and cheap to manufacture.

BACKGROUND OF THE INVENTION

Classic packaging, in particular packaging for edible fluids like water and beverages involves a container with a container body and a container neck, and a closure system that is attached to the container neck.

The attachment of the closure to the neck of the container requires the neck to have a minimal height (at least 10 mm) from the shoulder part of the container, to the upper edge of the said neck. There have been many recent attempts to decrease the height of the neck of containers in order to make containers more ecological, i.e. by using less plastic material to make them, but without great success. As a result the amount of material required to produce a packaging using less plastic material, that keeps a high resistance to mechanical constraints, and still is appealing to the consumer, is high.

It is therefore a primary objective of the present invention to provide a packaging solution comprising a container and a closure system to close this container, which has similar technical functionalities compared to the existing packaging solutions, while allowing a true and important decrease in the amount of material that is used to produce it.

As a second objective, a packaging solution is needed that comprises a closure that can be used during sport activities, or simply for "on-the-go" consumption, which also meets high standards in terms of technical functionalities (eg. good mechanical resistance), that is easy to use by a consumer, and is also cheaper to manufacture.

SUMMARY OF THE INVENTION

The objectives described above are met with a packaging comprising a container with a container body, and a container opening having an upper edge, and a closure element for closing said container.

According to the present invention, the said packaging is characterized in that the closure element is rigid and is ultrasonically sealed onto the upper edge of the container opening, so that said closure element and said container form one single unitary part.

With such a packaging, the need for a container neck is removed, hence a big decrease in the amount of packaging material that is needed. The rigidity of the closure element is essential to guarantee the resistance of the whole packaging, once this packaging is finished, i.e. once it is in one single part, it has a very good mechanical resistance, eg. to puncturing. Additionally, a completely rigid packaging allows to pack contents with an internal pressure, for instance gaseous products.

The ultrasonic sealing allows to completely and easily melt the constitutive material of the closure element and the container, so that after the ultrasonic sealing step has been achieved, these two constitutive parts cannot be distinguished from one another, and form an integral single piece of material. It is essential that the portions of the closure and the container which are assembled by ultrasonic sealing be made of the same material, so as to allow a proper and correct sealing of these two parts into only one piece.

In one first embodiment of the invention, the closure element comprises a spout and an overcap attached to the spout, the spout having a lower edge that is sealed onto the upper edge of the container opening.

In this first embodiment, the closure spout is directly fixed to the container upper edge by ultrasonic welding, which makes the screw threads on the closure and a container neck with corresponding screw threads superfluous.

In this embodiment, the overcap is preferably pivotably attached to the spout by a pivot hinge.

In a second alternative embodiment of the invention, the closure element comprises a ring-shaped base and an overcap attached to the base, the ring-shaped base having a lower edge that is sealed onto the upper edge of the container opening.

In this second embodiment, the overcap is preferably pivotably attached to the ring-shaped based by a pivot hinge.

In this case, the ring-shaped base is preferably less than 3 mm, more preferably less than 2 mm in height.

The container and the closure element are preferably made out of polyethylene terephtalate (PET), polyethylene naphtalate (PEN), or polypropylene (PP).

Furthermore, it is also preferred that the closure overcap be made out of polypropylene (PP) or polyethylene (PE).

Advantageously, the spout and overcap are manufactured as one single piece, for instance by co-injection. Alternatively, the said spout and overcap could be manufactured separately and simply be pre-assembled together, before the spout is ultrasonically sealed to the container upper edge.

In a highly preferred embodiment of the invention, the lower edge of the closure element comprises a rib protruding downwards that is meant to melt with the upper edge of the container during the ultrasonic sealing operation. Such a protruding rib transmits the ultrasonic waves between the closure and the upper edge of the container. At the same time, due to the ultrasonic waves, the said rib melts and creates the seam between the two constitutive parts of the packaging.

Advantageously, the packaging according to the present invention comprises tamper-evident means, said means preferably comprising a detachable tamper-evident band that is formed together with the closure, so that it catches one part of the container, thus preventing removal of the closure from said container, unless the said tamper-evident band is torn from the rest of the closure.

This invention addresses the drawbacks of the existing solutions, by providing a simple and economic sports-closure, that is convenient for use by the consumer and comprises tamper evident means.

BRIEF DESCRIPTION OF THE DRAWINGS

Additional features and advantages of the present invention are described in, and will be apparent from, the description of the presently preferred embodiments which are set out below with reference to the drawings in which:

FIGS. 2A and 2B are schematic views similar to FIG. 1, wherein FIG. 2B shows an overcap hingeably attached to the spout part of the closure, and in the open configuration (tamper-evident band is torn);

DETAILED DESCRIPTION OF THE INVENTION

Figure 1:
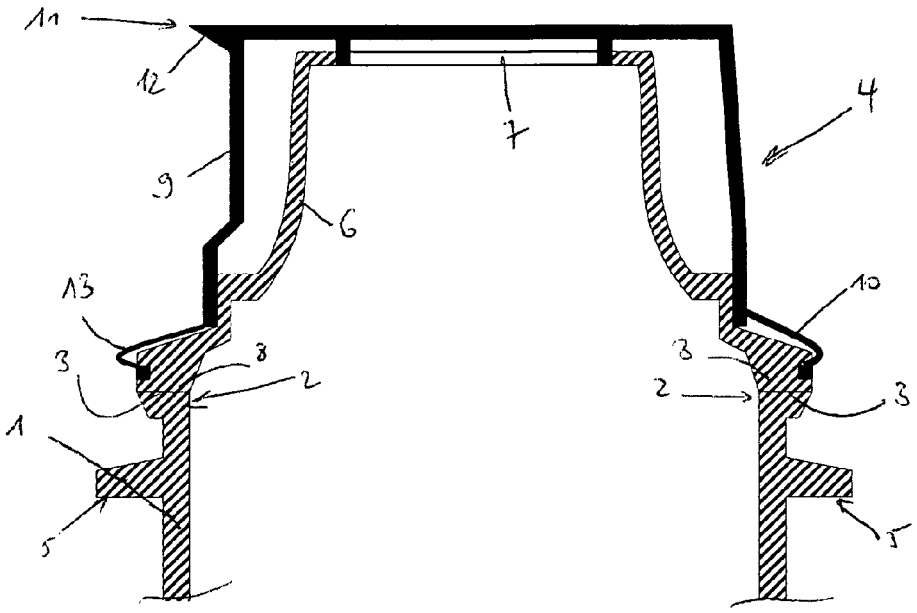
FIG. 1 is a schematic profile cut view of the upper part of the packaging showing the upper portion of a container, and a closure, as per the invention.

As illustrated in FIG. 1, the packaging according to the present invention comprises a container with a container body 1, and a container opening 2 having an upper edge 3, and a closure element 4 for closing said container.

The container upper portion, as illustrated in FIG. 1, can comprise an annular ring 5, which is used to hold and maintain said container (or container preform) on the conveying lines of a factory.

The closure element 4 is ultrasonically sealed onto the upper edge 3 of the container opening 2, so that said closure element and said container form one single unitary part as shown in FIG. 1.

The closure element 4 consists of a drinking spout 6 which has a substantially frusto-conical profile. The spout 6 comprises a dispensing opening 7 at its top side. The lower edge 8 of the spout 6 is of a diameter similar or equal to that of the upper edge 3 of the container, so that said lower edge 8 contacts the whole surface of the upper edge 3 of the container opening 2 when the two parts are placed in contact before an ultrasonic sealing is applied. After both pieces are ultrasonically sealed, the lower edge 8 of the closure and the upper edge 3 of the container cannot be distinguished one from the other, as illustrated in FIG. 1.

The closure element 4 further comprises an overcap 9, that is meant to close the dispensing opening 7 of the spout 6. More than that, the overcap 9 is meant to cover the outer surface of the spout 6, at least in the region of said spout which is to be in contact with a consumer mouth.

As shown in FIG. 1, the spout 6 and overcap 9 are manufactured as one single piece, for instance by co-injection, in spite of the fact that they can be made of two different materials like PET and PP.

Figure 2A:
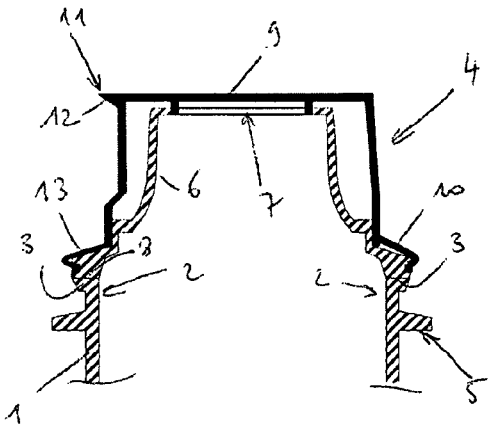
Figure 2B:
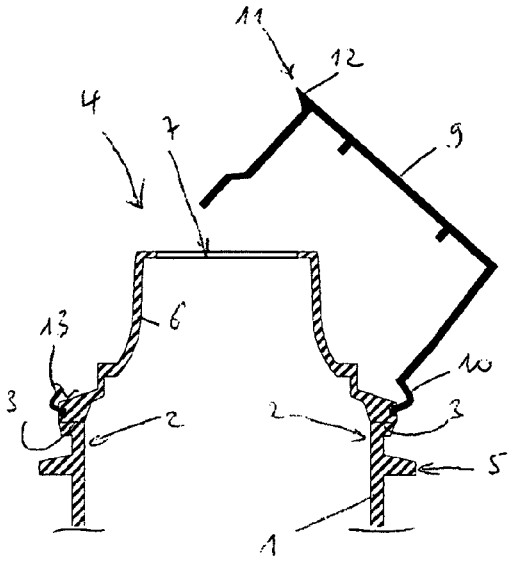

In FIGS. 1, 2A and 2B is illustrated a closure element 4 that comprises a drinking spout 6 and an overcap 9 attached to the spout, the spout 6 having a lower edge 8 that is sealed onto the upper edge 3 of the container opening 2. The benefit of such a construction is that a simple and user-friendly sports closure is achieved, wherein the spout is easy to place in the mouth for drinking, during a sports activity—for instance on a bike—and sipping water or a similar beverage directly from the spout allows to prevent spillage of the container contents.

As shown in FIG. 2B, the overcap 9 is pivotably attached to the spout 6 by a pivot hinge 10, which allows a consumer to open the closure 4, and sip some product from the container through the dispensing opening 7 of the spout, while ensuring that the overcap 9 is still attached to the rest of the closure. Preferably, as illustrated in the drawing, the front top part 11 of the overcap 9 comprises a protruding lifting tab 12, which the consumer can use to lift the overcap 9 with a finger or nail. Such a construction allows the consumer to open, use or close the package with only one hand, which is convenient when using the said packaging for instance during sports activities, or generally when the consumer does not have both hands free during consumption.

As can be seen in FIG. 2B, the first time the consumer lifts the overcap 9 to give access to the spout portion of the closure element 4, a tamper evident band is broken, a portion of which remains attached to the lower front portion of the spout 6.

As shown in FIG. 2A, the overcap 9 comprises a detachable tamper-evident band 13, that is formed together with the closure. The tamper evident band 13 is designed such that it catches one part of the container, thus preventing removal or opening—even partial opening—of the closure from said container unless the tamper-evident band is torn from the rest of the closure as illustrated in FIG. 2B.

In all embodiments of the present invention, the spout/closure is attached to the container with ultrasonic sealing after blowing the container preform and after filling the said container. This is to keep a big opening for blow-molding and filling (whereas a closure element tends to restrict the diameter of the package opening. Welding the spout on the preform before said preform is blown into a full-volume container might be possible, but would have clear disadvantages for blow molding and filling, as air and water need to be brought into the container and require sufficient diameter for the top opening for blowing and then filling.

Figure 3:
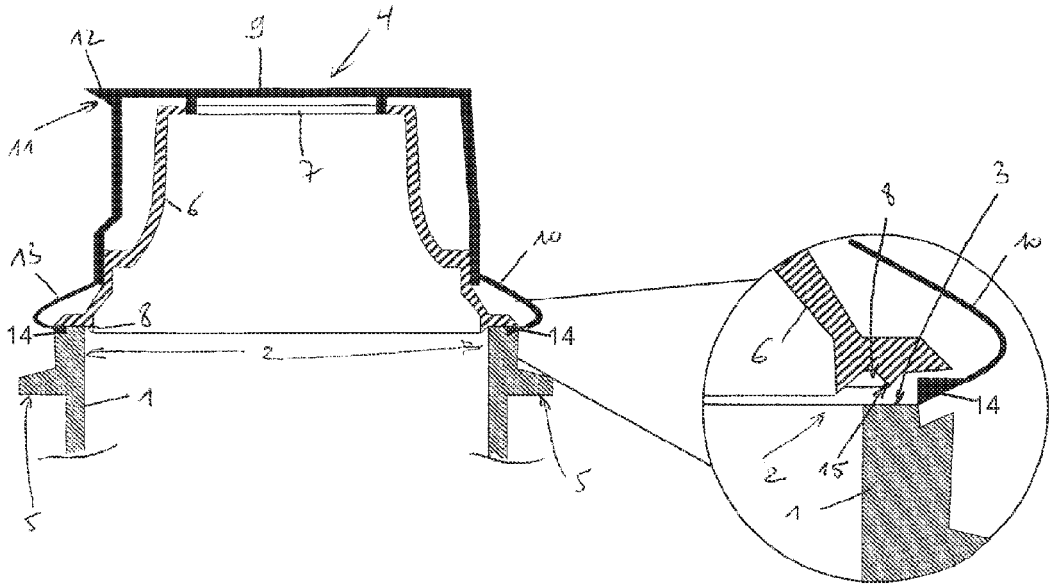
FIG. 3 is a schematic profile cut view showing an alternative packaging according to the invention, wherein the closure overcap is assembled to the spout and container by catching the annular tamper evident band and overcap hinge between the lower edge of the spout and the upper edge of the container preform.

Also as shown in FIG. 3, the overcap can be ultrasonically sealed to the upper portion of the container opening (it could also be ultrasonically sealed to the lower portion of the spout, which embodiment is not illustrated on the drawing). In this case, as shown in the FIG. 3, the overcap is hinged to a ring-shaped base 14, which is disposed between the upper edge of the container and the lower edge of the spout, into a groove designed to accommodate the ring-shaped base 14, and the latter is ultrasonically sealed to the spout and container, so that the three parts form one single piece after the sealing step.

The invention described above allows to dramatically reduce the mount of packaging material that is necessary to make the whole package: in this case, the closure is directly and unremovably attached to the container—for instance a bottle—without the need for attachment means between the two such as screw threads or clipping means. Moreover, there is no absolute need for a container neck to be present at the upper portion of the container.

In a highly preferred embodiment of the invention, as shown in the enlarged portion of the FIG. 3, the lower edge 8 of the closure element comprises a rib 15 protruding downwards that is meant to melt with the upper edge 3 of the container during the ultrasonic sealing operation. Such a protruding rib 15 transmits the ultrasonic waves during the ultrasonic welding operation, and especially transmits the ultrasonic waves between the closure and the upper edge of the container at a sharp contact point between the two parts to be welded. Due to the ultrasonic waves, the said rib melts and creates the seam between the two constitutive parts of the packaging.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A packaging comprising:

a container with a container body, a container opening having an upper edge, a closure element for closing the container, the closure element comprising a ring-shaped base and an overcap attached to the ring-shaped base, the ring-shaped base disposed between the upper edge of the container and a lower edge of a spout into a groove that is between the upper edge of the container and the lower edge of the spout, and accommodates the ring-shaped base, the closure element being rigid and ultrasonically sealed onto the upper edge of the container opening and the spout, so that the closure element and the container form one single unitary part, and a tamper-evident member comprising a detachable tamper-evident band that is formed together with the closure element so that the tamper-evident band catches one part of the container to prevent removal of the closure element from the container unless the tamper-evident band is torn from the rest of the closure element, the tamper-evident band extending outward past the upper edge of the container and then extending inward to connect to the upper edge of the container.

2. A packaging according to claim 1, wherein the lower edge is sealed onto the upper edge of the container opening.

3. A packaging according to claim 2, wherein the overcap is pivotably attached to the spout by a pivot hinge.

4. A packaging according to claim 2, wherein the overcap is pivotably attached to the ring-shaped based by a pivot hinge.

5. A packaging according to claim 2, wherein the ring-shaped base is less than 3 mm in height.

6. A packaging according to claim 1, wherein the container and the closure element are made out of a material selected from the group consisting of polyethylene terephtalate, polyethylene naphtalate, and polypropylene.

7. A packaging according to claim 2, wherein the overcap is made out of a material selected from the group consisting of polypropylene or polyethylene.

8. A packaging according to claim 2, wherein the spout and overcap are manufactured as a single piece.

9. A packaging according to claim 1, wherein the lower edge of the closure element to be sealed to the upper edge of the container, comprises a rib protruding downwards that is designed to melt with the upper edge of the container upper edge during ultrasonic sealing.

10. A packaging according to claim 2, wherein the overcap comprises protrusions that insert into a dispensing opening of the spout.

* * * * *